US009062901B2

(12) United States Patent
Jeon et al.

(10) Patent No.: US 9,062,901 B2
(45) Date of Patent: Jun. 23, 2015

(54) EVAPORATOR

(71) Applicant: HALLA CLIMATE CONTROL CORP., Daejeon (KR)

(72) Inventors: Young-Ha Jeon, Daejeon (KR); Jun Young Song, Daejeon (KR); Hong-Young Lim, Daejeon (KR); Jung Sam Gu, Daejeon (KR); Kwang Hun Oh, Daejeon (KR)

(73) Assignee: HALLA CLIMATE CONTROL CORP., Daejeon (KR)

( * ) Notice: Subject to any disclaimer, the term of this patent is extended or adjusted under 35 U.S.C. 154(b) by 226 days.

(21) Appl. No.: 13/874,099

(22) Filed: Apr. 30, 2013

(65) Prior Publication Data

US 2013/0312454 A1 Nov. 28, 2013

(30) Foreign Application Priority Data

May 22, 2012 (KR) ..... 10-2012-0054034

(51) Int. Cl.

| | |
|---|---|
| ***F25B 39/02*** | (2006.01) |
| ***F28F 9/02*** | (2006.01) |
| ***F28D 1/04*** | (2006.01) |
| ***F28D 1/053*** | (2006.01) |
| *F28F 9/26* | (2006.01) |
| *F28D 21/00* | (2006.01) |

(52) U.S. Cl.

CPC ..... *F25B 39/028* (2013.01); *F28F 9/0207* (2013.01); *F28F 9/0212* (2013.01); *F28F 9/0246* (2013.01); *F28F 9/26* (2013.01); *F28D 1/0417* (2013.01); *F28D 1/0435* (2013.01); *F28D 1/05341* (2013.01); *F28D 2021/0085* (2013.01)

(58) Field of Classification Search

CPC ..... F25B 39/028; F28F 9/0207; F28F 9/0246; F28F 9/0212; F28F 9/26; F28D 1/0435; F28D 1/0417; F28D 1/05341; F28D 2021/0085

USPC ..... 62/524, 515

See application file for complete search history.

(56) References Cited

U.S. PATENT DOCUMENTS

| | | | | |
|---|---|---|---|---|
| 6,871,508 | B2 * | 3/2005 | Wanami et al. | 62/196.4 |
| 2003/0177775 | A1 * | 9/2003 | Wanami et al. | 62/196.4 |
| 2006/0201198 | A1 * | 9/2006 | Nishino et al. | 62/525 |
| 2008/0099191 | A1 * | 5/2008 | Taras et al. | 165/174 |
| 2008/0141707 | A1 * | 6/2008 | Knight et al. | 62/498 |
| 2010/0031698 | A1 * | 2/2010 | Higashiyama | 62/525 |
| 2010/0071392 | A1 * | 3/2010 | Taras et al. | 62/118 |
| 2010/0206535 | A1 * | 8/2010 | Munoz et al. | 165/173 |
| 2011/0239696 | A1 * | 10/2011 | Takagi | 62/524 |
| 2011/0315363 | A1 * | 12/2011 | Matter et al. | 165/173 |

FOREIGN PATENT DOCUMENTS

| | | | |
|---|---|---|---|
| JP | 05-096784 | U | 12/1993 |
| JP | 2000-62452 | A | 2/2000 |

(Continued)

*Primary Examiner* — Mohammad M Ali

(74) *Attorney, Agent, or Firm* — Novick, Kim & Lee, PLLC; Jae Youn Kim

(57) ABSTRACT

Provided is an evaporator including a flow part having a refrigerant flow therein, separately from a first compartment and a second compartment to improve a refrigerant channel structure, in a double evaporator in which a refrigerant flows in a first column and a second column, respectively, thereby reducing the number of four inlets and outlets that is disposed in the first column and the second column, respectively.

13 Claims, 9 Drawing Sheets

(56) References Cited

FOREIGN PATENT DOCUMENTS

| | | | |
|---|---|---|---|
| JP | 2005-308384 | A | 11/2005 |
| JP | 2012-067994 | A | 4/2012 |
| KR | 10-2004-0091577 | A | 10/2004 |
| KR | 10-2006-0009653 | A | 2/2006 |
| KR | 10-2008-0103674 | A | 11/2008 |

* cited by examiner

- Prior Art -

- Prior Art -

EVAPORATOR

CROSS-REFERENCE TO RELATED APPLICATIONS

This application claims priority under 35 U.S.C. §119 to Korean Patent Application No. 10-2012-0054034, filed on May 22, 2012 in the Korean Intellectual Property Office, the disclosure of which is incorporated herein by reference in its entirety.

TECHNICAL FIELD

The following disclosure relates to an evaporator including a flow part having a refrigerant flow therein, separately from a first compartment and a second compartment to improve a refrigerant channel structure, in a double evaporator in which a refrigerant flows in a first column and a second column, respectively, thereby reducing the number of four inlets and outlets that is disposed in the first column and the second column, respectively.

BACKGROUND

An air conditioner for vehicles is an interior part of a car that is installed for the purpose of cooling or heating an interior of a car during summer season or winter season or removing a frost formed on a windshield during rainy weather or winter season, and the like, to allow a driver to secure a front and rear sight. The air conditioner usually includes both of the heating system and the cooling system to optionally introduce external air or internal air, heat or cool the air, and then send the air to an interior of a car, thereby cooling, heating, or ventilating the interior of a car.

A general refrigerating cycle of the air conditioner includes an evaporator that absorbs heat from the surroundings, a compressor that compresses a refrigerant, a condenser that discharges heat to the surroundings, an expansion valve that expanding the refrigerator. In the cooling system, the refrigerator in a gaseous state that is introduced into the compressor from the evaporator is compressed at high temperature and high pressure by the compressor, liquefaction heat is discharged to the surroundings while the compressed refrigerant in a gaseous state is liquefied by passing through the condenser, the liquefied refrigerant is in a low-temperature and low-pressure wet saturated steam state by again passing through the expansion valve, and is again introduced into the evaporator and vaporized to absorb vaporization heat and cool the surrounding air, thereby cooling the interior of a car.

Numerous researches for allowing representative heat exchangers, such as a condenser, an evaporator, and the like, that are used in the cooling system to more effectively exchange heat between air outside the heat exchanger and a heat exchange medium in the heat exchanger, that is, a refrigerant have been steadily conducted. The most direct effect in cooling the interior of a car is shown in evaporator efficiency. In particular, various structural research and developments for improving heat exchange efficiency of the evaporator have been conducted.

As one of the improved structures to increase the heat exchange efficiency of the evaporator, a double evaporation structure in which a core including a tube and a pin doubly forms a first column and a second column that are a space in which a refrigerant flows individually is proposed as an example.

As the related art, Japanese Patent Laid-Open Publication No. 2000-062452 ("Air conditioner for vehicles, Feb. 29, 2000), Japanese Patent Laid-Open Publication No. 2005-308384 ("Ejector cycle, Nov. 4, 2005), and the like, disclose a form similar to a double evaporator in which a refrigerant independently flows in the first column and the second column, respectively.

Meanwhile, an example of the evaporator having the double evaporation structure is illustrated in FIGS. 1 and 2. (FIG. 1 is a perspective view of the evaporator and FIG. 2 is a schematic diagram of a flow within the first column and the second column of the evaporator illustrated in FIG. 1).

An evaporator 1 illustrated in FIGS. 1 and 2 is configured to form a first header tank 11 and a second header tank 12 formed in parallel with each other, being spaced apart from each other by a predetermined distance and including at least one baffle 13 that is partitioned by a barrier rib to form a first column and a second column to partition each of the first compartments 10*a* and 20*a* and the second compartments 10*b* and 20*b* in a width direction and partition a space in a length direction; a first inlet that is connected with one portion of the first compartment 10*a* of the first header tank 11 to introduce a flowing refrigerant into the first column and a first outlet 42 that is connected with the other portion of the first compartment 10*a* of the first header tank 11 to discharge the refrigerant; a second inlet 43 that is connected with the other portion of the second compartment 10*b* of the first header tank 11 to introduce a flowing refrigerant into the second column and a second outlet that is connected with one portion of the second compartment 10*b* of the second header tank 12 to discharge the refrigerant; a plurality of tubes 20 of which both ends are fixed to the first header tank 11 and the second header tank 12; and a pin 30 interposed between the tubes 20.

Referring to FIG. 2, in the first column of the evaporator 1, a refrigerant is introduced into the first compartment 10*a* of the first header tank 11 through the first inlet 41 to move to the first compartment 20*a* of the second header tank 12 through the tube 20 and again move to the first compartment 10*a* of the first header tank 11 through the remaining tubes 20 and then is discharged through the first outlet 42.

In addition, in the second column, a refrigerant is introduced into the second compartment 10*b* of the first header tank 11 through the second inlet 43 to move to the second compartment 20*b* of the second header tank 12 through the tube 20 and again the second compartment 10*b* of the first header tank 11 through the remaining tubes 20 and is discharged through the second outlet.

In other words, in the evaporator 1 illustrated in FIGS. 1 and 2 the refrigerants of the first column and the second column flow individually. To this end, each of the inlets 41 and 43 and the outlets 42 and 44 for introducing and discharging the refrigerant into and from the first column and the second column are provided two and thus, become four in total.

Therefore, in the evaporator having the double evaporation structure four pipes forming the inlets and the outlets need to be connected with one another, and therefore manufacturing costs for manufacturing and fixing them cannot but increase. In particular, as illustrated in FIG. 1, in case of using a separate pipe fixing part for connecting and fixing the four pipes, the foregoing problem cannot but be more serious.

Further, in the evaporator having the double evaporation structure the pipe itself takes up a lot of interior space of an engine room to hinder the miniaturization of the evaporator and reduce a heat exchange region as much, thereby degrading the cooling performance.

Related Art Document

Patent Document

Patent Document 1) Japanese Patent Laid-Open Publication No. 2000-062452 ("Air conditioner for vehicles", Feb. 29, 2000)

Patent Document 2) Japanese Patent Laid-Open Publication No. 2005-308384 ("Ejector cycle", Nov. 4, 2005)

SUMMARY

An exemplary embodiment of the present invention is directed to providing an evaporator with the improved refrigerant channel structure using a flow part in a double evaporator in which a refrigerant independently flows in a first column and a second column, respectively, to solve a problem of degradation of productivity and difficulty of miniaturization due to an increase in the number of inlets and outlets.

In one general aspect, there is provided an evaporator 1000, including: a first header tank 100 and a second header tank 200 formed in parallel with each other, being spaced apart from each other by a predetermined distance and including at least one baffle 130 that is partitioned by a barrier rib 111 to form a first column and a second column to partition each of the first compartments 100*a* and 200*a* and the second compartments 100*b* and 200*b* in a width direction and partition a space in a length direction; plurality of tubes 300 of which both ends are fixed to the first header tank 100 and the second header tank 200; and a pin 400 interposed between the tubes, wherein the first header tank 100 includes a flow part 100*c* having a first communication hole 141 communicating with the second compartment 100*b* disposed at one portion thereof in a length direction and a second communication hole 142 communicating with the first compartment 100*a* disposed at the other portion thereof in a length direction to form a space in which a refrigerant flows, separately from the first compartment 100*a* and the second compartment 100*b*; a manifold 600 communicating with the first compartment 100*a* to form the first inlet 510 into which a refrigerant is introduced; an outlet 520 communicating with the first compartment 100*a* to discharge the refrigerant; and a second inlet 530 communicating with the second compartment 100*b* to introduce the refrigerant thereinto.

Both ends of the first header tank 100 may be closed by an end cap 150 that includes a plate part 151 disposed at one end thereof, a first hollow hole 152 of which the predetermined region corresponding to the first compartment 100*a* in a predetermined region of the plate part 151 is hollowed, and a second hollow hole 153 of which the predetermined region corresponding to the second compartment 100*b* in the predetermined region of the plate part 151 is hollowed.

The manifold 600 may include: a lower manifold 610 is connected with one 150 of the pair of end caps 150 and includes an opening part 611 that communicates with the first hollow hole 152, a closing part 612 that closes the second hollow hole 153, and a first extension 613 that extends in a width direction of the first header tank 100 in the first hole forming region; and an upper manifold 620 is coupled with the lower manifold 610 and includes a second extension 624 that forms the first inlet 510 along with the first extension 613.

The upper manifold 620 may be provided with a first space part 621 that is connected with the second extension 624 and protruded to form a space in which a refrigerant flows at a position corresponding to the opening part 611 forming region of the lower manifold 610.

The upper manifold 620 may be provided with a second space part 622 protruded to have the same length as the first space part 621 at a position corresponding to the closing part 612 forming region of the lower manifold 610.

The first header tank 100 may have a discharge hole 623 that is hollowed in the second space part 622 of the upper manifold 620.

At the mounting position of the evaporator 1000, the discharge hole 623 may be disposed under the second space part 622.

The lower manifold 610 may be protruded so that the opening part 611 forming region contacts an inner circumferential surface of the first hollow hole 152 of the end cap 150.

The end cap 150 connected with the manifold 600 may close the second hollow hole 153 to support the closing part 612.

The first header tank 100 may be formed by a coupling of a header 110 and a tank 120 in which the depressed part 121 of which the central region formed with the barrier rib 111 in a width direction is depressed is lengthily formed in a length direction, and may include a flow part forming member 140 that is provided to cover the depressed part 121 of the tank 120 and has the flow part 100*c* disposed therein.

The tank 120 of the first header tank 100 may be inclined to the barrier rib 111 so that the depressed part 121 has a "Y"-letter shape along with the barrier rib 111.

In the first header tank 100, the first inlet 510 may be formed at one portion of the first compartment 100*a*, the outlet 520 may be formed at the other portion of the first compartment 100*a*, the second inlet 530 may be connected with the other portion of the second compartment 100*b*, the first communication hole 141 may be disposed at the first depressed part 121 in a length direction so as to be adjacent to the first inlet 510 forming region, and the second communication hole 141 may be disposed at the first depressed part 121 in a length direction so as to be adjacent to the outlet 520 and the second inlet 530 forming region.

The evaporator 1000 may include: in the first column, a 1-1-th region A1-1 that the refrigerant introduced into the first compartment 100*a* of the first header tank 100 through the first inlet 510 moves to the first compartment 200*a* of the second header tank 200 through the tube 300 and a 1-2-th region A1-2 in which the refrigerant of the first compartment 200*a* of the second header tank 200 moves the first compartment 100*a* of the first header tank 100 through the tube 300; and in the second column, a 2-1-th region A2-1 in which the refrigerant introduced into the second compartment 100*b* of the first header tank 100 through the second inlet 530 moves to the second compartment 200*b* of the second header tank 200 through the tube 300 and a 2-2-th region in which the refrigerant of the second compartment 200*b* of the second header tank 200 moves to the second compartment 100*b* of the first header tank 100 through the tube 300, and the refrigerant passing through both of the 2-1-th region A2-1 and the 2-2-th region of the second column moves to the flow part 100*c* through the first communication hole 141 and moves in a length direction and is joined with the refrigerant discharged through the 1-1-th region A1-1 and the 1-2-th region A1-2 of the first column through the second communication hole 142 to be discharged through the outlet 520.

DETAILED DESCRIPTION OF MAIN ELEMENTS

Figure 1:
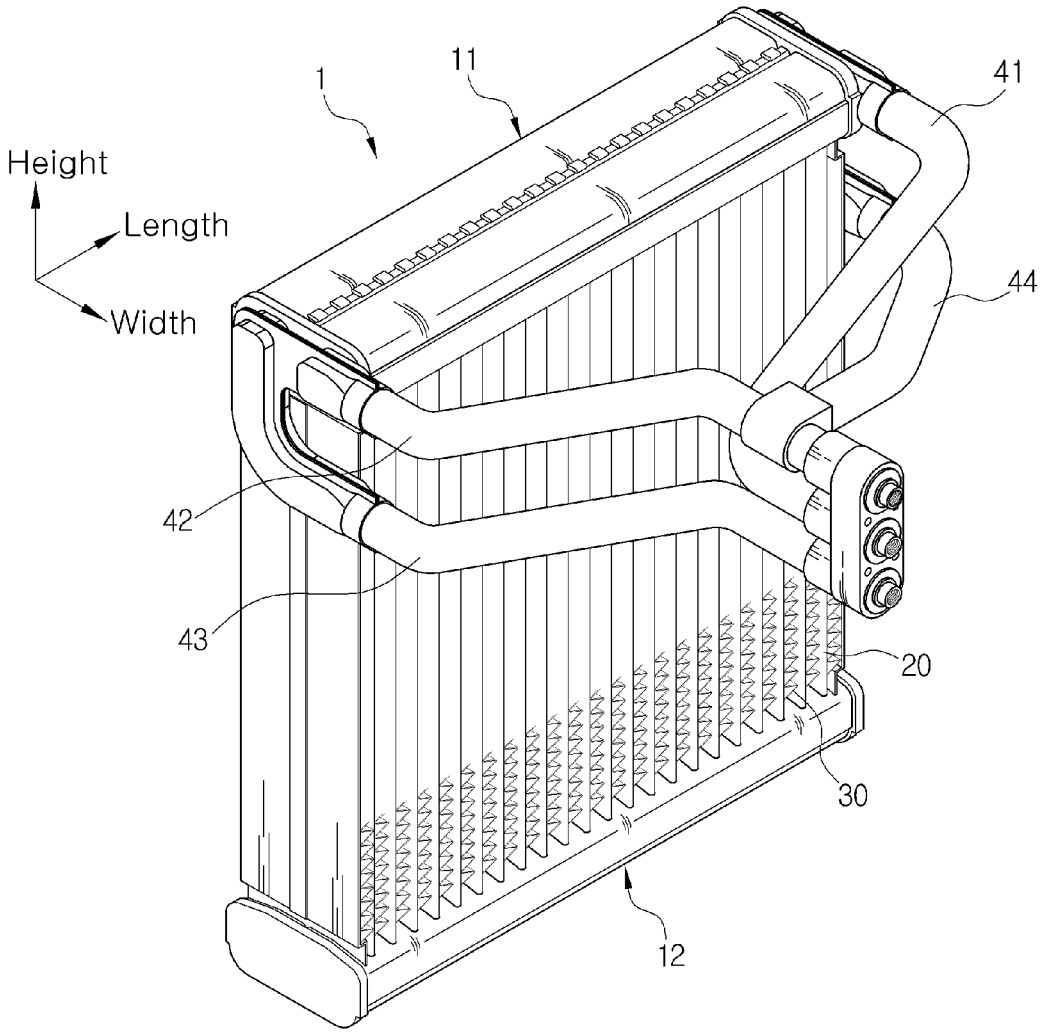
FIG. 1 is a perspective view illustrating an evaporator having a double evaporation structure according to the related art.
Figure 2:
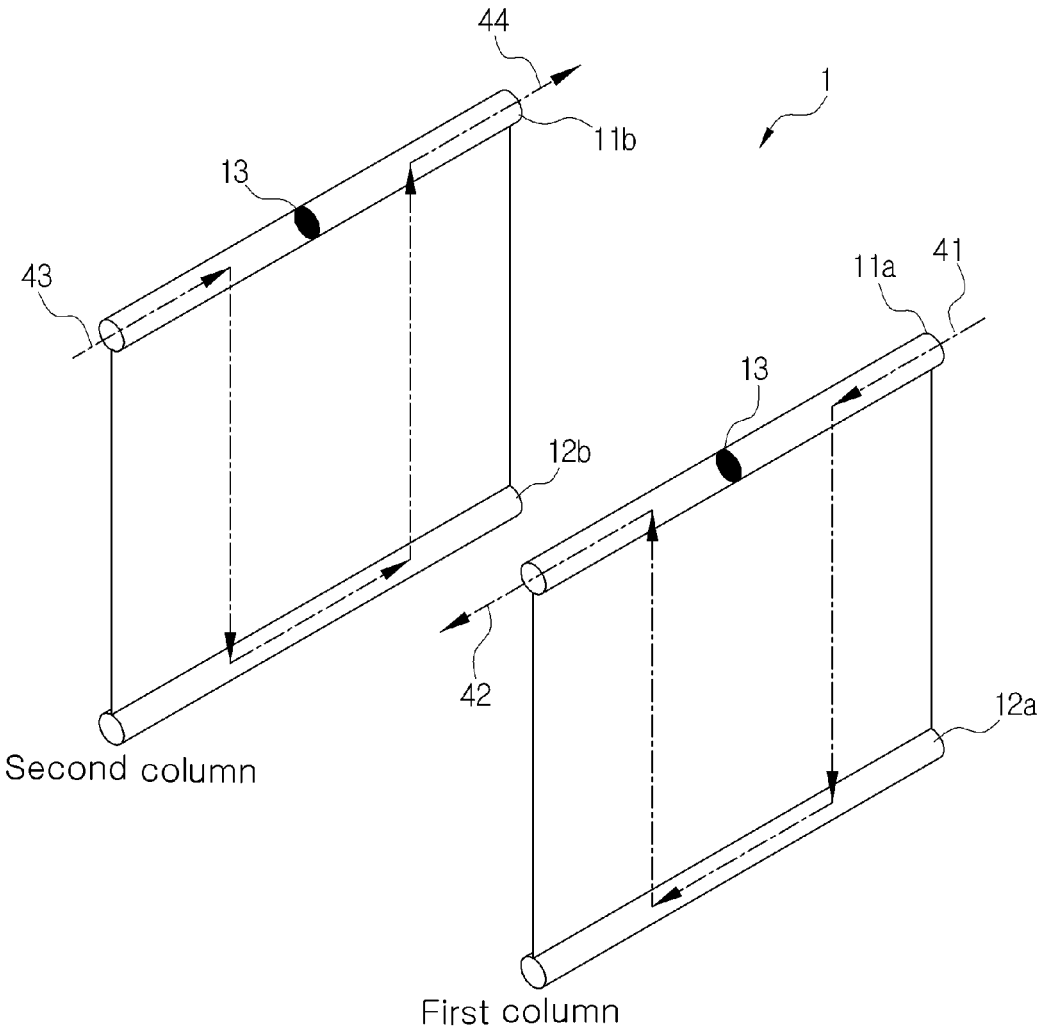
FIG. 2 is a schematic view illustrating a refrigerant flow within the evaporator illustrated in FIG. 1.

| | |
|---|---|
| 1000: Evaporator | |
| 100: First header tank | |
| 100a: First compartment | 100b: Second compartment |
| 100c: Flow part | 101: Third communication hole |
| 110: Header | 111: Barrier rib |
| 112: Tube insertion hole | 113: Protruded bead |
| 114: First fixed groove | |
| 120: Tank | 121: Depressed part |
| 122: Second fixed groove | 123: Third fixed groove |
| 130: Baffle | 131: First protruded part |
| 132: Barrier rib insertion groove | |
| 140: Flow part forming member | |
| 141: First communication hole | 142: Second communication hole |
| 150: End cap | 151: Plate part |
| 151a: Fixing force forming part | |
| 152: First hollow hole | 153: Second hollow hole |
| 200: Second header tank | |
| 200a: First compartment | 200b: Second compartment |
| 300: Tube | |
| 400: Pin | |
| 510: First inlet | 520: Outlet |
| 530: Second inlet | |
| 600: Manifold | |
| 610: Lower manifold | 611: Opening part |
| 612: Closing part | 613: First extension |
| 620: Lower manifold | |
| 621: First space part | 622: Second space part |
| 623: Discharge hole | |
| 624: Second extension | |

DETAILED DESCRIPTION OF EMBODIMENTS

Hereinafter, an evaporator 1000 according to the present disclosure having the above-mentioned characteristics will be described in more detail with reference to the accompanying drawings.

The evaporator 1000 according to the present invention includes a first header tank 100, a second header tank 200, tubes 300, and a pin 400, in which the first header tank 100 is provided with a flow part 100*c*.

First, the first header tank 100 and the second header tank 200 are formed in parallel with each other, being spaced from each other by a predetermined distance and include at least one baffle 130 that is partitioned by a barrier rib 111 to form a first column and a second column to partition each of the first compartments 100*a* and 200*a* and the second compartments 100*b* and 200*b* in a width direction and partitions a space in a length direction.

The evaporator 1000 according to the present invention has a configuration in which a flow part 100*c* is formed in the first header tank 100 but can be variously practiced and various examples thereof will be described again.

The tube 300 has a configuration of forming a refrigerant channel of which both ends are fixed to the first header tank 100 and the second header tank 200 and the tube 300 is configured to form two columns, including a column that communicates with the first compartments 100*a* and 200*a* of the first header tank 100 and the second header tank 200 and a column that communicates with the second compartments 100*b* and 200*b* of the first header tank 100 and the second header tank 200.

The pin 400 is interposed between the tubes 300.

In this case, the first header tank 100 is configured to include a manifold 600 that communicates with the first compartment 100*a* to form a first inlet 510 into which a refrigerant is introduced so as to have the refrigerant flow in the first column and the second column, respectively; an outlet 520 that communicates with the first compartment 100*a* to discharge a refrigerant; and a second inlet 530 that communicates with the second compartment 100*b* so as to introduce a refrigerant thereinto.

That is, in the evaporator 1000 according to the present invention, the first inlet 510 that introduces a refrigerant into the first column (first compartment 100*a*) is formed by the manifold 600.

The flow part 100*c* serves to deliver a refrigerant to the first compartment 100*a* so as to moving the refrigerant to the second column 100*b* of the first header tank 100 by passing through the second column to the first compartment 100*a* so as to be discharged together with the refrigerant passing through the first column. To this end, the flow part 100*c* is provided with a first communication hole 141 has the first communication hole 141 communicating with the second compartment 100*b* disposed on one portion thereof in a length direction and a second communication hole 142 communicating with the first compartment 100*a* disposed the other portion thereof in a length direction.

In this case, both ends of the first header tank 100 may be provided with the end cap 150, in more detail, the end cap 150 may have a form that includes a plate part 151 disposed at one end thereof, a first hollow hole 152 of which the predetermined region corresponding to the first compartment 100*a* in the predetermined region of the plate part 151 is hollowed, and a second hollow hole 153 of which the predetermined region corresponding to the second compartment 100*b* in the predetermined region of the plate part 151 is hollowed.

The end cap 150 closes both ends of the first header tank 100 and is configured to connect the manifold 600, the second inlet 530, and the outlet 520.

The manifold 600 closes one portion of the first header tank 100 and forms the first inlet 510.

The manifold 600 is configured to include a lower manifold 610 and an upper manifold 620.

The lower manifold 610 is connected with the end cap 150 and is configured to include an opening part 611 that communicates with the first hollow hole 152, a closing part 612 that closes the second hollow hole 153, and a first extension 613 that extends in a width direction of the first header tank 100 in the first hole forming region.

In this case, the opening part 611 is a part hollowed to have a refrigerant flow in the first compartment 100*a* through the first hollow hole 152 and the closing part 612 is configured to close the second hollow hole 153.

The lower manifold 610 may be protruded so that the opening part 611 forming region contacts an inner circumferential surface of the first hollow hole 152 of the end cap 150.

That is, the evaporator 1000 according to the present invention may have the improved assembly performance and the adhesion so that a circumference of the opening part 611 forming region is protruded to contact the inner circumferential surface of the first hollow hole 152 of the end cap 150.

In this case, the lower manifold 610 may have a stepped form to limit a depth inserted into the first hollow hole 152 of the end cap 150, while forming the opening part 611. (see FIG. 6)

Figure 6:
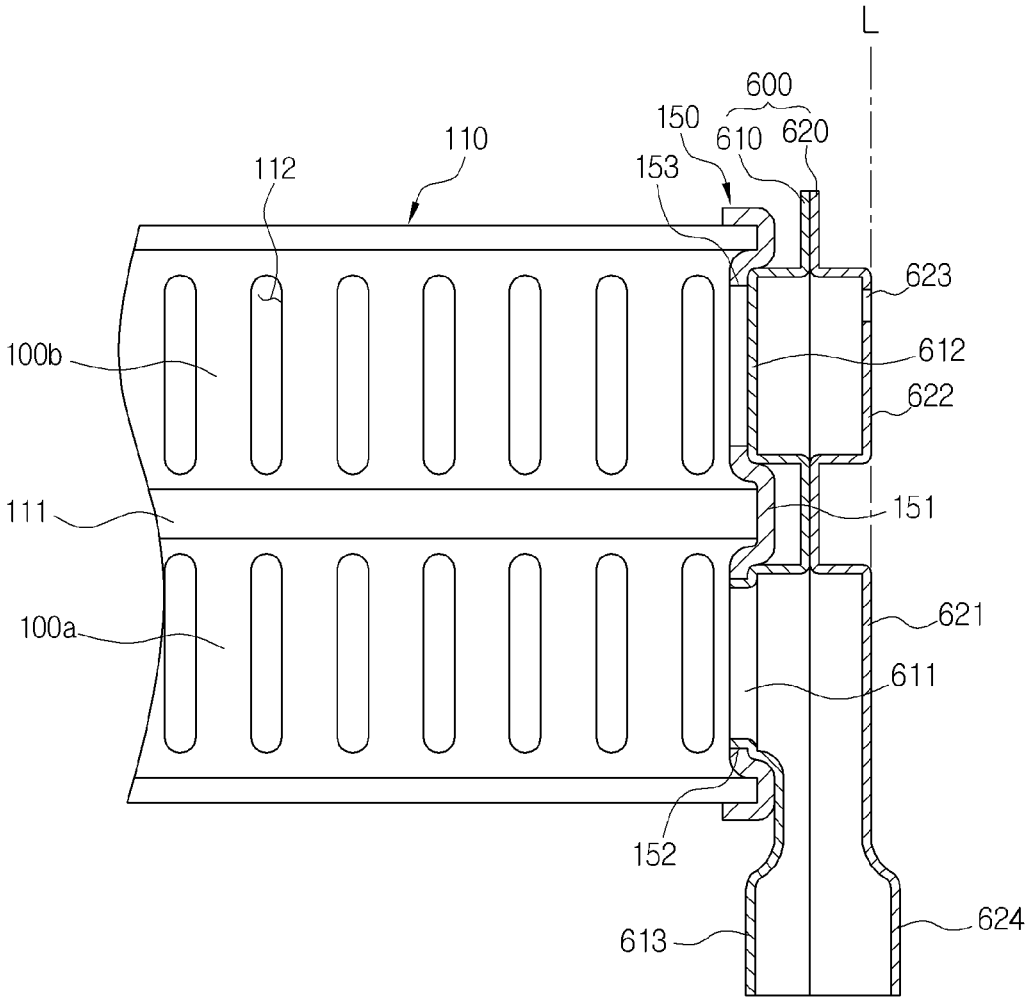

Alternatively, the end cap 150 of a portion 600 in which the manifold is disposed has a form in which the first hollow hole 152 and the second hollow hole 153 are hollowed as illustrated in FIG. 6, which may have the same form as the end cap 150 of a portion in which the outlet 520 and the second inlet 530 are disposed.

Figure 7:
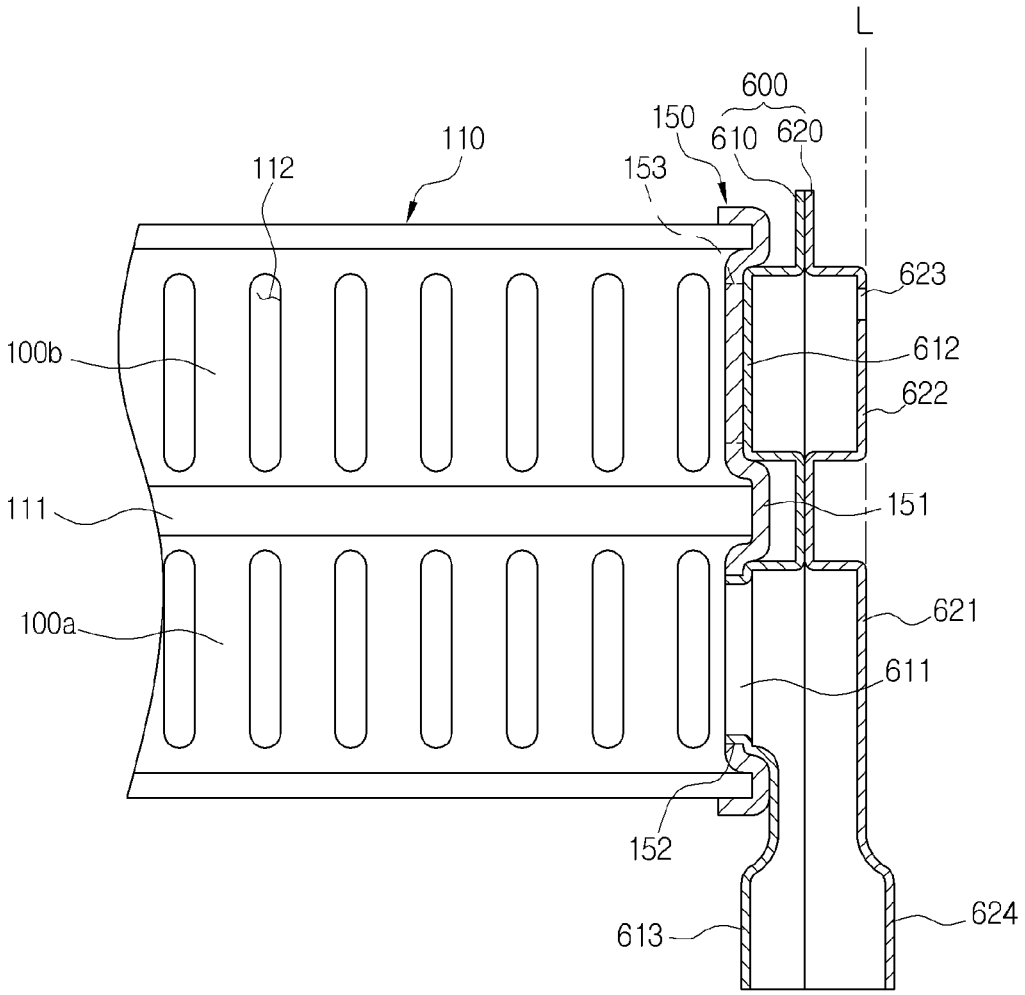
FIG. 7 is a cross-sectional view of another evaporator according to the present invention.

Further, as illustrated in FIG. 7, the end cap 150 of a portion in which the manifold 600 is disposed may have a form in which the second hollow hole 153 is closed.

That is, FIG. 7 illustrates a form in which the end cap 150 closes a portion of the second compartment 100*b* of the first header tank 100, which is formed to support the closing part 612 of the lower manifold 610.

In other words, FIG. 6 illustrates a form in which one portion of the second compartment 100*b* of the first header tank 100 is blocked by the closing part 612, such that the end cap 150 having the same form may be used at both portions of the first header tank 100.

FIG. 7 illustrates a form in which one portion of the second compartment 100*b* of the first header tank 100 is blocked by the end cap 150, which may stably support and bond the lower manifold 610 and more reduce a possibility of the leakage of the refrigerant within the second compartment 100*b*.

The upper manifold 620 is coupled with the lower manifold 610 and includes a second extension 624 that forms the first inlet 510 along with the first extension 613.

In addition, the upper manifold is provided with a first space part 621 that is connected with the second extension 624 and protruded to form a space in which the refrigerant flows at a position corresponding to the opening part 611 forming region.

The first space part 621 is configured to connect the first inlet 510 with the first compartment 100*a*, in which a refrigerant moves to the first space part 621 through the first inlet 510 (inner space in which the first extension 613 and the second extension 624 are formed) and the refrigerant is introduced into the first compartment 100*a* through the opening part 6111 and the first hollow hole 152.

Further, the upper header tank 620 is provided with a second space part 622 protruded to have the same length as the first space part 621 at a position corresponding to the closing part 612 forming region.

The second space part 622 is provided with the second space part 622 in which a refrigerant does not flow, but has a length corresponding to the first space part 621 to facilitate the mounting of the evaporator 1000 (so as not to change the form of the air conditioner case included in the evaporator 1000). (see FIG. 6)

In FIGS. 6 and 7, the rightmost line formed by the first space part 621 and the second space part 622 is represented by reference numeral L.

In other words, the inside of the second space part 622 is a space in which a refrigerant does not flow and is protruded to have the same length as the first space part 621 in the external form of the evaporator 1000, such that one portion of the evaporator 1000 has the same surface part and is easily mounted, thereby preventing air from being leaked within the air conditioner case.

Meanwhile, in the evaporator 1000 according to the present invention, when the surface of the evaporator 1000 is coated with a coating solution so as to more increase durability and secure antibiosis, the second space part 622 of the upper manifold 620 is provided with a discharge hole 623 that is hollowed to communicate with an inside and an outside of the second space part 622, thereby previously preventing problems in that a coating solution permeated into the second space part 622 may not be discharged or the condensed water discharged to the surface thereof may be pooled in the second space part 622.

In this case, in order to increase the drainage efficiency of the discharge hole 623, at the mounting position of the evaporator 1000, the discharge hole 623 may be disposed under the second space part 622.

The first header tank 100 including the flow part 100*c* may be formed by various methods and may be configured of a combination of the header 110 and the tank 120 will be described.

Figure 3:
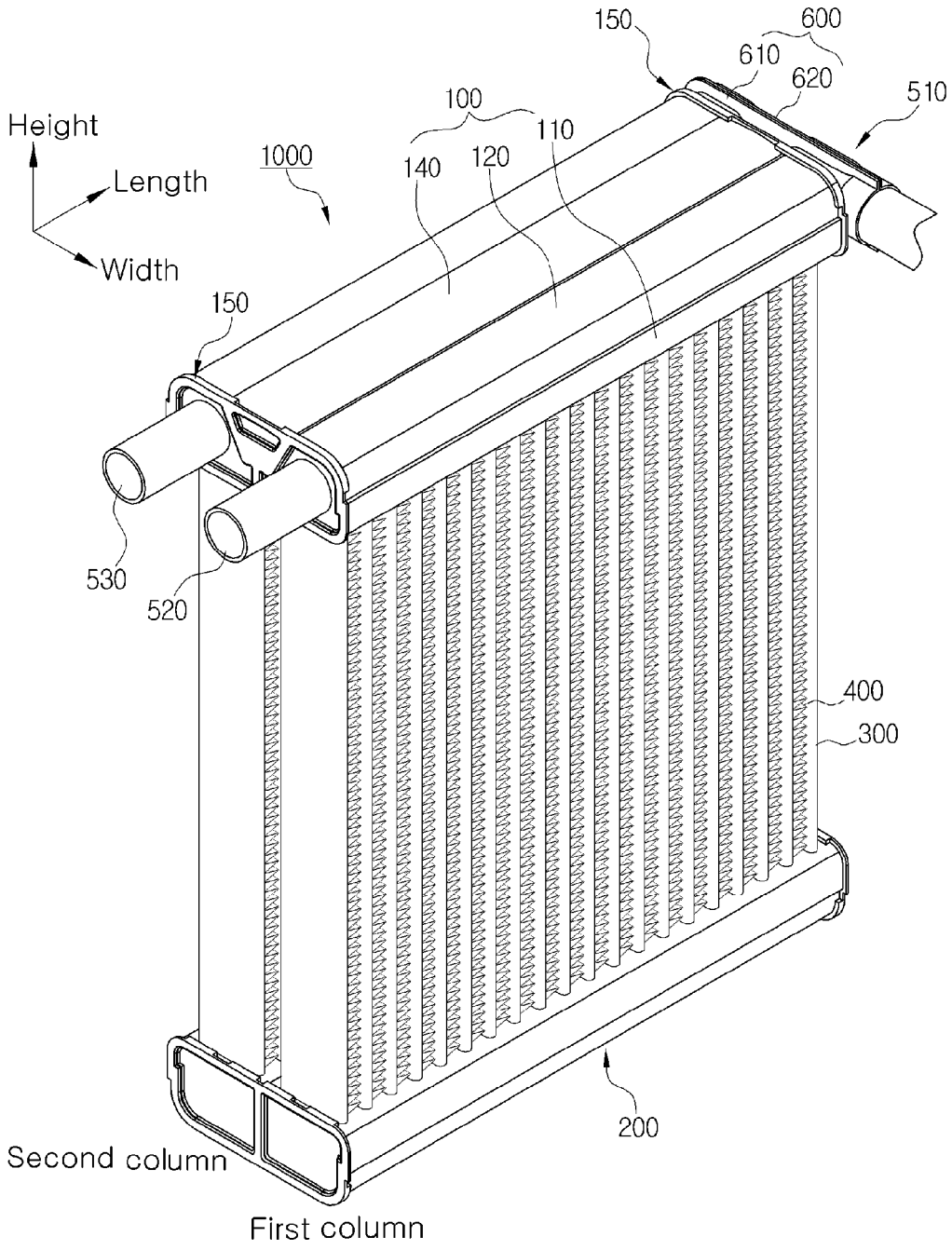
FIGS. 3 to 6 are a perspective view of an evaporator according to the present invention and an exploded perspective view, a partial exploded perspective view, and a cross-sectional view of a first header tank.
Figure 4:
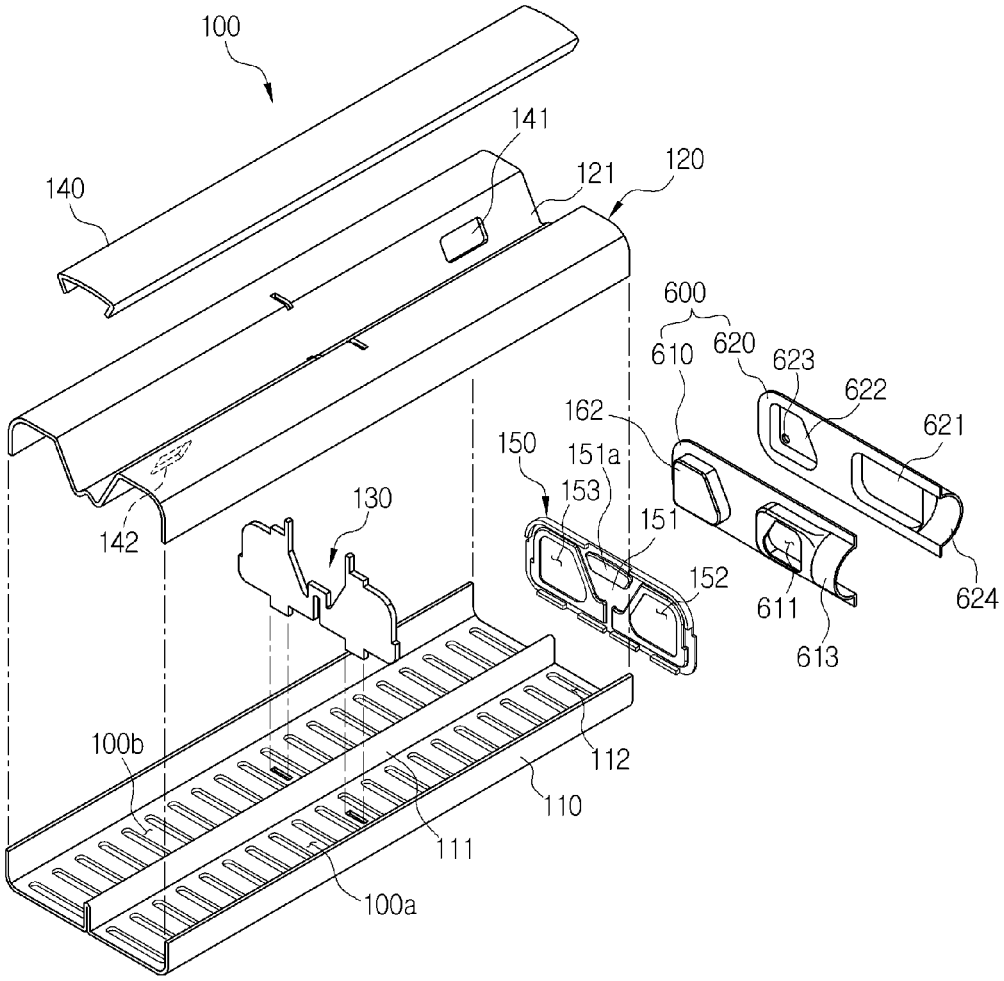
Figure 5:
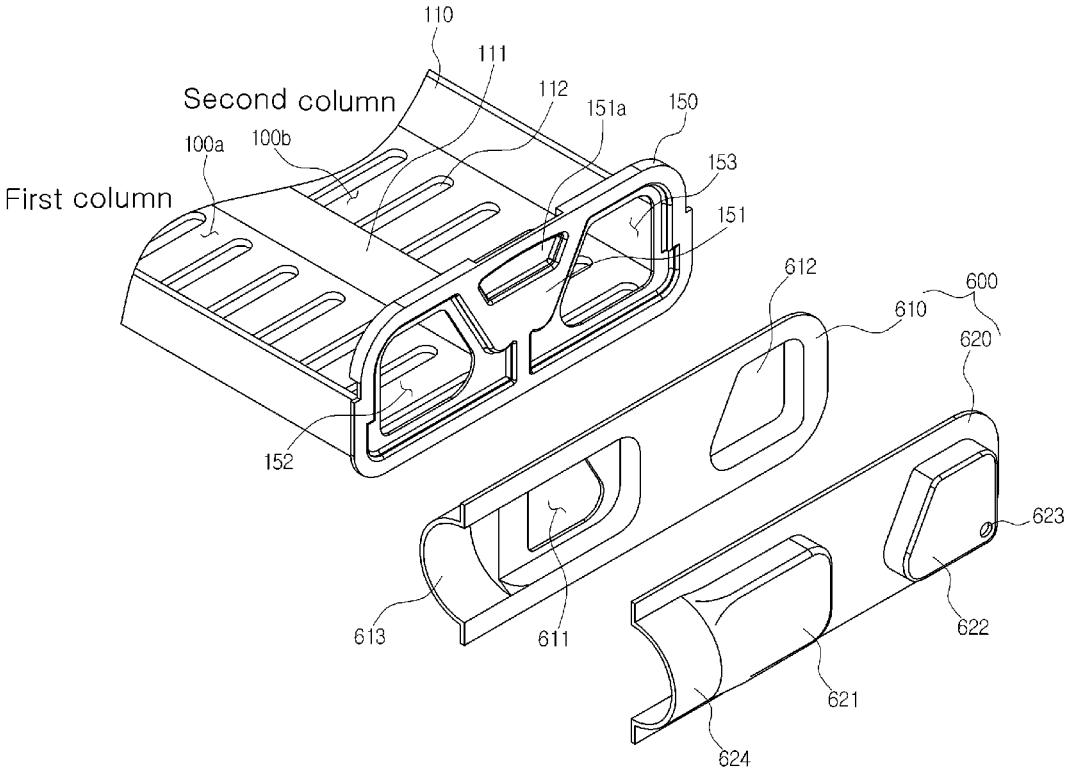

FIGS. 3 to 5 are a perspective view of the evaporator 1000 according to the present invention and an exploded perspective view and a cross-sectional view of the first header tank 100 and in the evaporator 1000 according to the present invention illustrated in FIGS. 3 to 5, an example in which the first header tank 100 is formed by a combination of the header 110 and the tank 120, the tank 120 is provided with a depressed part 121, and the flow part 100*c* is formed using a flow part forming member 140 covering the depressed part 121 is illustrated.

First, the header 110 is provided with a tube insertion hole 112 into which the predetermined region of the tube 300 is formed and may be integrally formed with the barrier rib 111.

In more detail, the tank 120 of the first header tank 100 may be formed in a width direction and the depressed part 121 of which the central region formed with the barrier rib 111 is depressed is lengthily formed in a length direction, and the first header tank 100 includes the flow part forming member 140 provided to cover the depressed part 121 of the tank 120, so that a portion surrounded by the depressed part 121 of the tank 120 and the flow part forming member 140 forms the flow part 100*c*.

In this case, the first communication hole 141 through which the second compartment 100*b* and the flow part 100*c* communicate with each other and the second communication hole 142 through which first compartment 100*a* and the flow part 100*c* communicate with each other are formed in the depressed part 121 and the first communication hole 141 is disposed at a portion formed with the first inlet 510 in a length direction so as to deliver all the refrigerants flowing in the second column to the flow part 100*c* and the second communication hole 142 is disposed at a portion formed with the outlet 520 in a length direction so as to smoothly discharge the refrigerant moving through the length direction of the flow part 100*c* along with the refrigerant passing through the first column.

In addition, the tank 120 may be inclined to the barrier rib 111 so that the depressed part 121 forms a "Y"-letter shape along with the barrier rib 111, thereby effectively secure the inner space of the flow part 100*c*, the first compartment 100*a*, and the second compartment 100*b* sufficiently secure the size of the first communication hole 141 and the second communication hole 142 to smoothly move the refrigerant.

In this case, the first header tank 100 may have the end cap 150 disposed at both ends thereof and a fixing force enhancement part 151*a* may be formed to correspond to the flow part 100*c* to more improve the fixing force of the flow part forming member 140.

In addition, in the first header tank 100, the first inlet 510, the outlet 520, and the second inlet 530 may be more variously formed.

Figure 8:
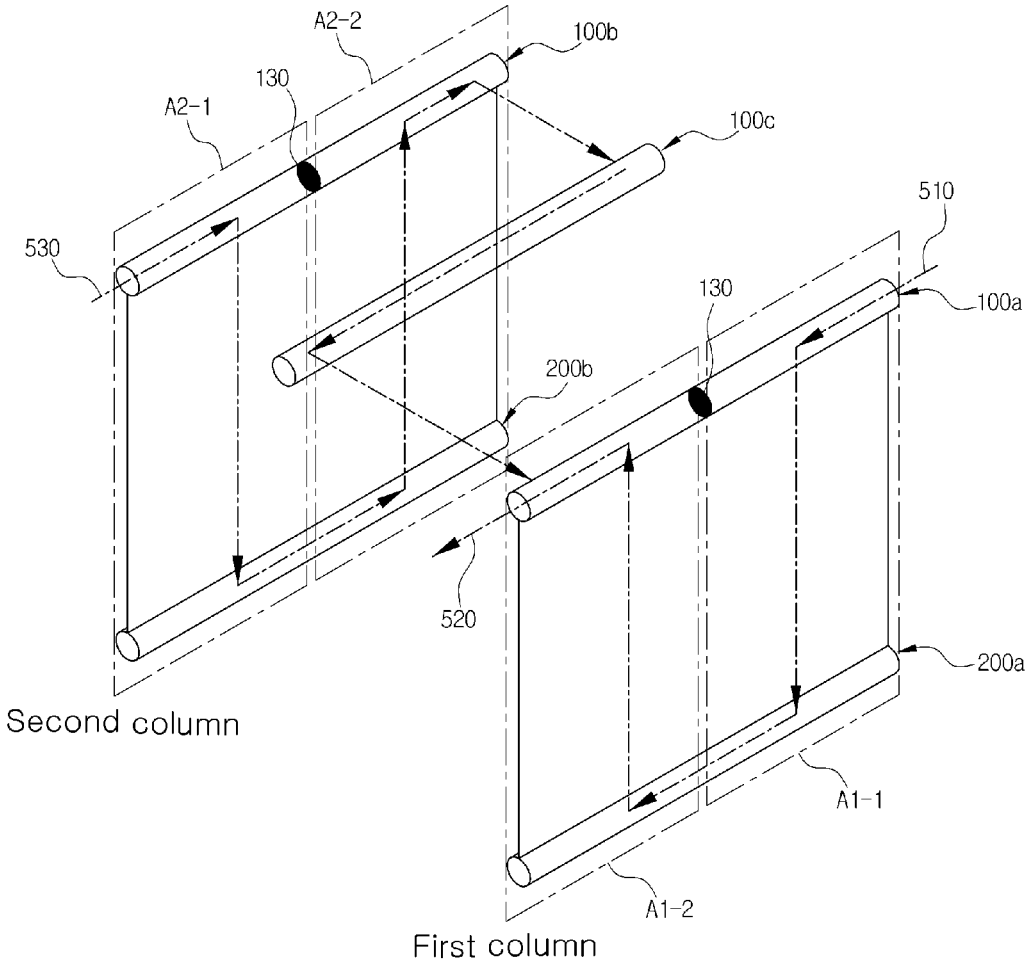
FIGS. 8 and 9 each are diagrams illustrating an example of a refrigerant flow within the evaporator illustrated in FIG. 3.
Figure 9:
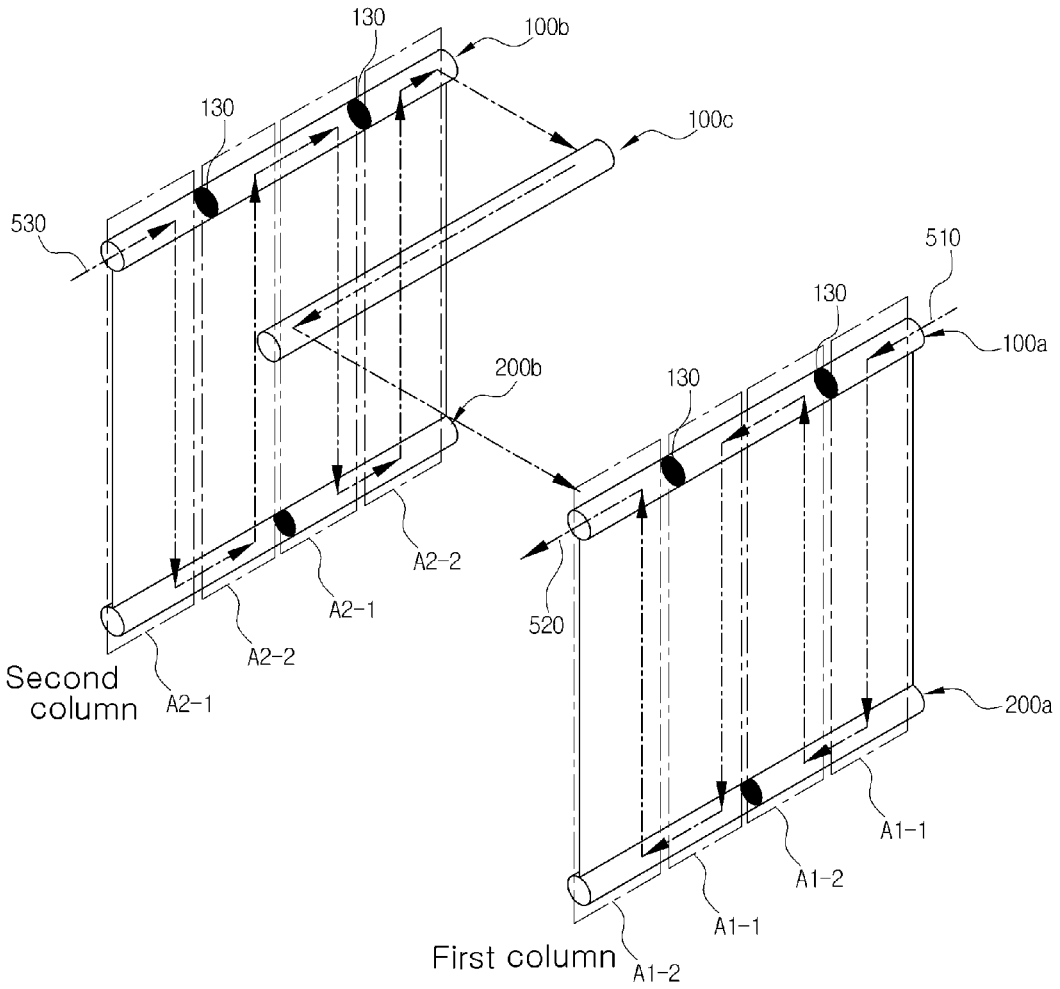

FIGS. 8 and 9 are schematic diagrams illustrating an example of the refrigerant flow of the evaporator 1000 according to the present invention illustrated in FIG. 3 and in the evaporator 1000 according to the present invention, the first inlet 510 may be formed at one portion of the first compartment 100*a*, the outlet 520 may be formed at the other portion of the first compartment 100*a*, the second inlet 530 may be connected with the other portion of the second compartment 100*b*, the first communication hole 141 may be disposed at the first depressed part 121 in a length direction so as to be adjacent to the first inlet 510 forming region, and the second communication hole 141 may be disposed at the first depressed part 121 in a length direction so as to be adjacent to the outlet 520 and the first inlet 510 forming region.

In more detail, FIG. 8 illustrates a flow in which in the first column, the refrigerant introduced through the first inlet 510 passes through the 1-1-th region A1-1 (the first compartment 100*a* of the first header tank 100→the first compartment 200*a* of the second header tank 200)—the 1-2-th region A1-2 (the first compartment 200*a* of the second header tank 200→the first compartment 100*a* of the first header tank 100) and is discharged and in the second column, the refrigerant introduced through the second inlet 530 passes through the 2-1-th region A2-1 (the second compartment 100*b* of the first header tank 100→the second compartment 200*b* of the second header tank 200)—the 2-2-th region A2-2 (the second compartment 200*b* of the second header tank 200→the first compartment 100*a* of the first header tank 100), moves to the flow part 100*c* through the first communication hole 141, and is joined with the refrigerant discharged from the inside of the first column through the second communication hole 142 and is discharged.

In the evaporator 1000 according to the present invention illustrated in FIGS. 3 to 5, an example in which the inside of the first header tank 100 is provided with one baffle 130, the baffle 130 is provided with a first protrusion 131, two places of the header are provided with first fixed grooves 114 that fix the first protrusion 131, and the baffle 130 is provided with a barrier rib insertion groove 132 into which the barrier rib 111 of the header 110 is inserted is illustrated, which is only one embodiment, and therefore the shape, number, fixing method, and the like of the baffle 130 may be more variously formed.

FIG. 9 illustrates a structure in which in the first column, the refrigerant introduced through the first inlet 510 passes through the 1-1-th region A1-1 (the first compartment 100*a* of the first header tank 100→the first compartment 200*a* of the second header tank 200)—the 1-2-th region A1-2 (the first compartment 200*a* of the second header tank 200→the first compartment 100*a* of the first header tank 100)—the 1-1-th region A1-1 (the first compartment 100*a* of the first header tank 100→the second compartment 200*a* of the second header tank 200—the 1-2-th region A1-2 (the first compartment 200*a* of the second header tank 200→the first compartment 100*a* of the first header tank 100) and is discharged and in the second column, the refrigerant introduced through the second inlet 530 passes through the 2-1-th region A2-1 (the second compartment 100*b* of the first header tank 100→the second compartment 200*b* of the second header tank 200)—the 2-2-th region A2-2 (the second compartment 200*b* of the second header tank 200→the first compartment 100*a* of the first header tank 100)—the 2-1-th region A2-1 (the second compartment 100*b* of the first header tank 100→the second compartment 200*b* of the second header tank 200)—the 2-2 region A2-2 (the second compartment 200*b* of the second header tank 200∴the first compartment 100*a* of the first header tank 100), moves to the flow part 100*c* through the first communication hole 141, and is joined with the refrigerant discharged from the first column through the second communication hole 142 and is discharged.

Therefore, the evaporator 1000 according to the present invention relates to the double evaporator 1000 in which the refrigerant flows in the first column and the second column, respectively, in which the refrigerant channel structure may be improved by forming the depressed part 121 in the tank 120 and forming the flow part 100*c* having the refrigerant flow therein using the flow part formation members 140, separately the first compartment 100*a* and the second compartment 100*b*, such that each of the first column and the second column is provided with the inlet and the outlet, thereby reducing the total number of four inlets and outlets that is disposed in the first column and the second column, respectively.

Therefore, the evaporator 1000 according to the present invention can reduce the number of components and simplify the assembly process to improve the production efficiency and reduce the number of outlets as compared with the related art to more reduce the number of connection pipe lines, thereby realizing the miniaturization.

According to the present invention, the evaporator includes the flow part having a refrigerant flow therein, separately from the first compartment and the second compartment to improve the refrigerant channel structure, in the double evaporator in which the refrigerant flow flows in the first column and the second column, respectively, thereby reducing the number of four inlets and outlets that is disposed in the first column and the second column, respectively.

Therefore, the evaporator according to the present invention can reduce the number of components and simplify the assembly process to improve the production efficiency and reduce the number of outlets as compared with the related art to more reduce the number of connection pipe lines, thereby realizing the miniaturization.

Further, the evaporator according to the present invention forms the first inlet using the manifold and make the length of the first column and second column portions same without changing the shape of the air conditioner case, such that the evaporator can be easily designed and prevent the air leakage.

Further, the evaporator according to the present invention includes the discharge hole, thereby easily discharging the liquids used in the manufacturing process of the inside of the second space part or the condensed water formed on the surface of the evaporator.

The present invention is not limited to the above-mentioned exemplary embodiments, and may be variously applied, and may be variously modified without departing from the gist of the present invention claimed in the claims.

What is claimed is:

1. An evaporator, comprising:

a first header tank and a second header tank formed in parallel with each other, being spaced apart from each other by a predetermined distance and including at least one baffle that is partitioned by a barrier rib to form a first column and a second column to partition each of a first compartment and a second compartment in a width direction and partition a space in a length direction;

a plurality of tubes of which both ends are fixed to the first header tank and the second header tank; and a pin interposed between the tubes, wherein the first header tank includes:

a flow part having a first communication hole communicating with the second compartment and disposed at one portion thereof in a length direction and a second communication hole communicating with the first compartment and disposed at another portion thereof in a length direction to form a space in which a refrigerant flows separately from the first compartment and the second compartment;

a manifold communicating with the first compartment to form a first inlet into which a refrigerant is introduced;

an outlet communicating with the first compartment to discharge the refrigerant; and a second inlet communicating with the second compartment to introduce the refrigerant thereinto.

2. The evaporator of claim 1, wherein both ends of the first header tank are closed by an end cap that includes a plate part disposed at one end thereof, and the first header tank comprises a first hollow hole corresponding to the first compartment and disposed in a predetermined region of the plate part and a second hollow hole corresponding to the second compartment and disposed in another predetermined region of the plate part.

3. The evaporator of claim 2, wherein the manifold includes:

a lower manifold connected with the end cap and including an opening part that communicates with the first hollow hole, a closing part that closes the second hollow hole, and a first extension that extends in a width direction of the first header tank in a first hole forming region; and an upper manifold coupled with the lower manifold and including a second extension that forms the first inlet along with the first extension.

4. The evaporator of claim 3, wherein the upper manifold includes a first space part that is connected with the second extension and protruded to form a space in which the refrigerant flows at a position corresponding to an opening part forming region of the lower manifold.

5. The evaporator of claim 4, wherein the upper manifold includes a second space part protruded to have the same length as the first space part at a position corresponding to a closing part forming region of the lower manifold.

6. The evaporator of claim 5, wherein the first header tank has a discharge hole that is hollowed in the second space part of the upper manifold.

7. The evaporator of claim 6, wherein at a mounting position of the evaporator, the discharge hole is disposed under the second space part.

8. The evaporator of claim 4, wherein the lower manifold is protruded so that the opening part forming region contacts an inner circumferential surface of the first hollow hole of the end cap.

9. The evaporator of claim 3, wherein the end cap connected with the manifold closes the second hollow hole to support the closing part.

10. The evaporator of claim 1, wherein the first header tank is formed by a coupling of a header and a tank in which a depressed part is lengthily formed in a length direction, and the first header tank includes a flow part forming member that is provided to cover the depressed part of the tank and has the flow part disposed therein.

11. The evaporator of claim 10, wherein the tank of the first header tank is inclined to the barrier rib so that the depressed part has a "Y"-letter shape along with the barrier rib.

12. The evaporator of claim 10, wherein, in the first header tank, the first inlet is formed at one portion of the first compartment, the outlet is formed at another portion of the first compartment, the second inlet is connected with one portion of the second compartment, the first communication hole is disposed at the depressed part in a length direction so as to be adjacent to a first inlet forming region, and the second communication hole is disposed at the depressed part in a length direction so as to be adjacent to the outlet and a second inlet forming region.

13. The evaporator of claim 12, further comprising:

a 11th region disposed in the first column, wherein the refrigerant introduced into the first compartment of the first header tank through the first inlet moves to the first compartment of the second header tank through the tubes and a 12th region in which the refrigerant of the first compartment of the second header tank moves into the first compartment of the first header tank through the tubes; and a 21th region disposed in the second column in which the refrigerant introduced into the second compartment of the first header tank through the second inlet moves to the second compartment of the second header tank through the tubes and a 22th region in which the refrigerant of the second compartment of the second header tank moves to the second compartment of the first header tank through the tubes, and wherein the refrigerant passing through both of the 21th region and the 22th region of the second column moves to the flow part through the first communication hole and moves in a length direction and is joined with the refrigerant discharged through the 11th region and the 12th region of the first column and through the second communication hole, and the joined refrigerant is discharged through the outlet.

* * * * *